US007473295B2

(12) United States Patent
Mårs et al.

(10) Patent No.: US 7,473,295 B2
(45) Date of Patent: Jan. 6, 2009

(54) STAINLESS STEEL POWDER

(75) Inventors: Owe Mårs, Höganäs (SE); Ricardo Canto Leyton, Kallinge (SE); Ola Bergman, Helsingborg (SE)

(73) Assignee: Höganäs AB, Höganäs (SE)

( * ) Notice: Subject to any disclaimer, the term of this patent is extended or adjusted under 35 U.S.C. 154(b) by 108 days.

(21) Appl. No.: 11/171,195

(22) Filed: Jul. 1, 2005

(65) Prior Publication Data

US 2006/0002813 A1 Jan. 5, 2006

Related U.S. Application Data

(60) Provisional application No. 60/610,971, filed on Sep. 20, 2004.

(30) Foreign Application Priority Data

Jul. 2, 2004 (SE) ..... 0401707

(51) Int. Cl.
*B22F 3/12* (2006.01)
*B22F 1/00* (2006.01)

(52) U.S. Cl. ..... 75/246; 75/231; 75/252; 75/255; 419/38

(58) Field of Classification Search ..... 75/255, 75/252, 231, 246; 419/38
See application file for complete search history.

(56) References Cited

U.S. PATENT DOCUMENTS

| | | | | |
|---|---|---|---|---|
| 3,455,681 | A * | 7/1969 | Moskowitz et al. | 420/63 |
| 3,490,956 | A * | 1/1970 | Wilton | 148/606 |
| 3,689,325 | A * | 9/1972 | Haydent et al. | 148/609 |
| 5,395,583 | A * | 3/1995 | Potgieter et al. | 420/67 |
| 5,856,625 | A | 1/1999 | Saunders et al. | |
| 6,342,087 | B1 * | 1/2002 | Arvidsson et al. | 75/255 |
| 6,569,221 | B2 * | 5/2003 | Berglund | 75/255 |
| 6,712,873 | B2 * | 3/2004 | Bergkvist et al. | 75/252 |
| 2003/0133824 | A1 * | 7/2003 | Taguchi et al. | 420/70 |

FOREIGN PATENT DOCUMENTS

| | | |
|---|---|---|
| JP | 56-158844 | 12/1981 |
| JP | 59-47358 | 3/1984 |
| WO | WO 98/58093 | 12/1998 |
| WO | WO 03/106077 | 12/2003 |

* cited by examiner

*Primary Examiner*—Roy King
*Assistant Examiner*—Ngoclan T Mai
(74) *Attorney, Agent, or Firm*—Buchanan Ingersoll & Rooney PC

(57) ABSTRACT

The invention concerns a stainless steel powder comprising at least 10% chromium by weight. The powder further comprises vanadium in an amount of at least 4 times the amount of carbon and nitrogen. Preferably the steel powder comprises 10-30% chromium, 0.1-1% vanadium, 0.5-1.5% silicon, at least 0.1% carbon and at least 0.07% nitrogen. The invention also concerns a powder metallurgical composition containing said steel powder, a process for preparing and a compacted and sintered part made of said composition.

15 Claims, No Drawings

STAINLESS STEEL POWDER

The benefit is claimed under 35 U.S.C. § 119(a)-(d) of Swedish Application No. 0401707-5, filed July 2, 2004, and under 35 U.S.C. § 119(e) of U.S. Provisional Application No. 60/610,971, filed Sep. 20, 2004.

FIELD OF THE INVENTION

The present invention concerns a new stainless steel powder and stainless steel powder compositions including this new powder. Specifically the invention concerns stainless steel powder compositions for manufacturing sintered powder metallurgical parts having high densities.

BACKGROUND OF THE INVENTION

A primary goal in powder metallurgy is to achieve high density of compacted and sintered bodies. There are several methods of improving density, one of those methods is warm compaction which improves the compressibility of the powder giving a green body with higher green density. By applying die wall lubrication, which makes it possible to minimise the amount of internal lubricants used, the green density may also be increased. The use of high compaction pressures in combination with low amounts of lubricants also results in elevated green densities. Soft annealing of a stainless steel powder, where the material is strain relieved and recrystallized, also improves the compressibility. After compaction the green body is subjected to a sintering operation in order to achieve a sintered body. High temperatures at sintering, i.e. above about 1180-1200° C. lead to increased shrinkage during sintering and higher density of the body. However, high temperature sintering requires specially equipped sintering furnaces. Additionally the energy consumption will be increased.

Special problems are encountered when high density, stainless steel PM parts are manufactured due to the presence of chromium, which makes the steel resistant to corrosion.

Stainless steels have approximately above 10% chromium. Most often carbon is present in steels and will cause formation of chromium carbides. The formation of chromium carbides lowers the chromium content in the matrix, which in turn causes lower corrosion resistance. In order to avoid that the chromium content in the matrix is reduced, carbide forming stabilizers, such as niobium, are often used. In this way the formation of chromium carbides can be avoided and instead niobium carbides are formed, a result of which is that the corrosion resistance can be maintained. However, a problem with the use of niobium is that high sintering temperatures are necessary for obtaining high sintered densities and the energy consumption is considerable.

It has now been found that, by using the new powder according to the present invention, the energy costs for producing sintered stainless steel PM parts can be reduced. Another significant advantage of using the new powder is that a comparatively higher sintered density can be obtained.

The sintered parts manufactured by using the new powder are of particularly interest within the automotive industry where the demands on both costs and performance of the parts are high. The new powder can also be used for sintered parts in exhaust systems, and especially for flanges in exhaust systems.

The present invention concerns stainless steel powder, stainless steel powder compositions as well as the compacted and sintered parts obtained thereof having high densities.

Specifically the invention concerns stainless steel powder compositions for manufacturing powder metallurgical parts.

SUMMARY OF THE INVENTION

It has now surprisingly been found that, by adding vanadium as a stabiliser to a stainless steel powder, the sintering temperature and accordingly the energy consumption can be reduced, while the sintered density is similar or even increased in comparison with the presently used niobium stabiliser. Furthermore it has been found that the vanadium should be present in an amount of at least 4 times the combined amounts of carbon and nitrogen, whereby the amount of nitrogen should be less than 0.07% by weight and the amount of carbon should be less than 0.1% by weight. The amount of vanadium should be in the range of 0.1-1% by weight.

Stainless steel compositions including vanadium are disclosed in WO 03/106077 publication and in the U.S. Pat. No. 5,856,625. In WO 03/106077 there is not disclosed any effect or any actual examples of powders including vanadium. According to the U.S. Pat. No. 5,856,625 the stainless steel powder preferably comprises 1.5-2.5% vanadium. This known stainless steel powder is intended for materials with high wear resistance and a high carbon content is necessary to achieve a proper amount of hard carbides in the matrix formed mainly from strong carbide forming elements such as Mo, V and W. Also the patent publication JP 59-47358 discloses a steel powder is comprising chromium, silicon, carbon and nitrogen. This powder may further contain nickel and/or copper and vanadium. The purpose of the the steel powder according to JP 59-47356 is to manufacture e.g. a sliding surface.

DETAILED DESCRIPTION OF THE INVENTION

Specifically, the stainless steel powder according to the invention comprises 10-30% chromium, 0.1-1% vanadium, 0.5-1.5% silicon, less than 0.1% carbon and less than 0.07% nitrogen. Preferably the stainless steel powder comprises 10-20% chromium, 0.15-0.8% vanadium, 0.7-1.2% silicon, less than 0.05% carbon and less than 0.05% nitrogen.

As the corrosion resistance in stainless steels is of great interest the vanadium content should be chosen so that vanadium carbides and nitrides are formed instead of chromium carbides and nitrides. Preferably the vanadium content will be chosen in relation to the actual carbon and nitrogen content in the sintered component to be able to form vanadium carbides and nitrides. It is believed that the vanadium carbides and nitrides formed are of type VC and NC and according to our present knowledge the vanadium content should preferably be minimum 4 times the carbon and nitrogen content of the powder. The actual carbon and nitrogen content in the sintered component may be higher than the content of the elements in the powder due to pick up during delubrication.

The amount of silicon should be between 0.5% to 1.5%. Silicon is an important element as it creates a thin coherent oxide layer during atomisation of the stainless steel melt, i.e. the silicon content should be 0.5% by weight or above. The oxide layer prevents further oxidation. A too high silicon level will lead to a decrease in compressibility, hence the silicon content should be 1.5% by weight or lower.

The amount of nitrogen should be as low as possible as nitrogen can have the same influence as carbon, i.e. sensitising the material through formation of chromium nitrides or chromium carbonitrides. Nitrogen has also a precipitation hardening effect which will decrease the compressibility. Therefore the nitrogen content should not exceed 0.07%, preferably not 0.05% by weight. In practice it is difficult to obtain nitrogen contents lower than 0.001%.

Other alloying elements are added to enhance certain properties, such as strength, hardness etc. The alloying elements are selected from the group consisting of molybdenum, copper, manganese and nickel.

According to the present invention ferritic stainless steels are preferred. Ferritic stainless steels are less expensive than austenitic stainless steels which are alloyed with nickel. Compared with an austenitic matrix a ferritic matrix has a lower coefficient of thermal expansion, which is beneficial for example in flanges in a stainless steel exhaust system. Therefore a preferred embodiment of the stainless steel according to the invention is essentially free from nickel. Specifically the ferritic stainless steel may comprise 10-20% by weight of chromium, 0-5% by weight of molybdenum, less than 1% by weight of nickel, less than 0.2% by weight of manganese.

Other possible additives are flow agents, machinability improving agents such as calcium fluoride, manganese sulfide, boron nitride or combinations thereof.

The stainless steel powder may be a gas or water atomised, pre-alloyed powder having an average particle size above about 20 μm, depending on the method of consolidation of the powder. Normally the average particle size is above about 50 μm.

Most often a lubricant is added prior to compaction in order to enhance the compressibility of the powder and to facilitate the ejection of the green component. The amount of lubricant is typically between 0.1% and 2%, preferably between 0.3% and 1.5%. The lubricants may be chosen from the group consisting of metal sterates, such as zink or lithium stearate, Kenolube®, amide polymers or amide oligomers, ethylene bisstearamide, fatty acid derivatives or other suitable substances with a lubricating effect. Die wall lubrication alone or in combination with internal lubricants may also be used.

After an optional annealing the stainless steel powder is mixed with lubricant and other optional additives. The powder mixture is compacted at 400-1200 MPa and sintered at 1150-1350° C. for 5 minutes to 1 hour to obtain a density of at least 7.20 g/cm$^3$. However, the powder according to the invention can be used for producing parts having lower sintered density in order to reduce processing costs. The compaction step could be performed as cold compaction or warm compaction.

The high sintered density is obtained by increased shrinkage during the sintering and without being bound to any specific theory, it is believed that this shrinkage is a consequence of promoted volume diffusion. Vanadium carbides which are formed in presence of carbon will be dissolved at elevated temperatures, especially at sintering temperatures, but also at lower temperatures such as at annealing of the metal powder. Normally the sintering temperature for stainless steel powders is about 1150-1300° C.

EXAMPLE 1

Three different melts having a chemical composition according to table 1 and containing niobium and vanadium as carbide forming elements were produced. Several mixtures were prepared for cold or warm compaction according to table 2 and 3. For cold compaction and warm compaction purposes lubricants were used. As a flow agent in warm compaction Aerosil A-200 from Degussa® was used.

TABLE 1

Chemical analysis of unannealed powders

| Batch | Cr % | Nb % | V % | Si % | Mn % | Ni % | P % | C % | N % | O % | S % |
|---|---|---|---|---|---|---|---|---|---|---|---|
| A | 11.85 | — | 0.29 | 0.68 | 0.23 | 0.053 | 0.008 | 0.024 | 0.014 | 0.144 | 0.0033 |
| B | 11.94 | 0.39 | — | 0.68 | 0.23 | 0.051 | 0.010 | 0.025 | 0.011 | 0.152 | 0.0027 |
| C | 11.79 | 0.58 | — | 0.73 | 0.23 | 0.056 | 0.009 | 0.026 | 0.011 | 0.143 | 0.0030 |

TABLE 2

Mixtures for cold compaction

| Mixture no | Composition |
|---|---|
| 4* | A + 1% lubricant |
| 5 | B + 1% lubricant |
| 6 | C + 1% lubricant |

*= composition according to the invention

TABLE 3

Mixtures for warm compaction

| Mixture no | Composition |
|---|---|
| 10* | A + 1% lubricant + 0.1% A-200 |
| 11 | B + 1% lubricant + 0.1% A-200 |
| 12 | C + 1% lubricant + 0.1% A-200 |

*= composition according to the invention

The powder mixtures according to table 2 and 3 were compacted and green properties were determined for various compaction pressures. The results are presented in table 4. The compacted bodies were sintered at 1250° C. in an atmosphere of hydrogen for 45 minutes and the sintered densities and mechanical properties were determined. The results are shown in table 5.

TABLE 4

| Mixture no | Compaction pressure | Green strength (Mpa) | Green density (g/cm$^3$) |
|---|---|---|---|
| 4* | 600 | 15.3 | 6.57 |
| | 700 | 18.0 | 6.69 |
| | 800 | 19.3 | 6.79 |
| 5 | 600 | 15.4 | 6.55 |
| | 700 | 18.1 | 6.68 |
| | 800 | 19.5 | 6.80 |
| 6 | 600 | 15.3 | 6.55 |
| | 700 | 18.1 | 6.68 |
| | 800 | 19.4 | 6.78 |
| 10* | 600 | 31.3 | 6.73 |
| | 700 | 37.5 | 6.87 |
| | 800 | 39.9 | 6.96 |
| 11 | 600 | 30.1 | 6.71 |
| | 700 | 36.7 | 6.86 |
| | 800 | 40.4 | 6.96 |
| 12 | 600 | 29.4 | 6.71 |
| | 700 | 34.9 | 6.86 |
| | 800 | 39.4 | 6.96 |

*= composition according to the invention

TABLE 5

| Mixture no | Compaction pressure (MPa) | Sintered density (g/cm$^3$) | Dimensional change (%) | Yield strength (MPa) | Tensile strength (MPa) |
|---|---|---|---|---|---|
| 4* | 600 | 7.36 | −3.87 | 222 | 390 |
| | 700 | 7.42 | −3.29 | 216 | 409 |
| | 800 | 7.45 | −2.71 | 215 | 405 |
| 5 | 600 | 7.24 | −3.48 | 204 | 366 |
| | 700 | 7.31 | −3.09 | 208 | 375 |
| | 800 | 7.38 | −2.82 | 228 | 384 |
| 6 | 600 | 7.10 | −2.85 | 202 | 356 |
| | 700 | 7.20 | −2.55 | 208 | 366 |
| | 800 | 7.26 | −2.30 | 213 | 376 |
| 10* | 600 | 7.42 | −3.38 | 221 | 420 |
| | 700 | 7.47 | −2.67 | 230 | 434 |
| | 800 | 7.49 | −2.20 | 234 | 431 |
| 11 | 600 | 7.28 | −2.93 | 206 | 371 |
| | 700 | 7.36 | −2.52 | 210 | 386 |
| | 800 | 7.43 | −2.20 | 216 | 400 |
| 12 | 600 | 7.16 | −2.36 | 203 | 361 |
| | 700 | 7.27 | −2.05 | 212 | 377 |
| | 800 | 7.33 | −1.79 | 214 | 389 |

*= composition according to the invention

From table 4 and table 5 it can clearly be identified that the sintered densities of the samples produced from the material according to the invention are improved, while the green densities of the material according to the invention are similar to the comparative materials. The mechanical properties of the sintered components are also improved with material according to the invention compared with known materials.

EXAMPLE 2

In order to evaluate the influence of sintering temperatures and sintering times, powder mixtures 4, 5 and 6 were compacted into tensile test samples according to ISO 2740 in a uniaxially compaction movement at ambient temperature at 600 MPa. The obtained green samples were sintered at 1200° C., 1250° C. and 1300° C. in an atmosphere of hydrogen for 20 minutes and 45 minutes, respectively.

After sintering the sintered density of the sintered samples were measured according to ISO 3369. The results are shown in table 6. From table 6 it can be concluded that sintered densities above 7.2 a/cm$^3$ can be obtained for a ferritic stainless steel powder provided vanadium is added, even at a sintering temperature as low as 1200° C. A sintering time of 20 minutes at a sintering temperature of 1250° C. yields a sintered density of 7.35 g/cm$^3$, whereas the corresponding density for the niobium stabilized ferritic stainless steel powder is 7.15 g/cm$^3$ and 7.03 g/cm$^3$ respectively, depending on the amount of niobium added.

The example reveals a surprisingly great impact on the shrinkage during sintering of a green body produced from ferritic stainless steel powder according to the invention.

TABLE 6

| Mixture | Sintering | Sintered densities (g/cm$^3$) at different sintering temperatures | | |
|---|---|---|---|---|
| no | time (min) | 1200° C. | 1250° C. | 1300°C. |
| 4* | 45 | 7.29 | 7.36 | 7.46 |
| 5 | 45 | 7.03 | 7.24 | 7.47 |
| 6 | 45 | 6.92 | 7.1 | 7.38 |
| 4* | 20 | — | 7.35 | — |
| 5 | 20 | — | 7.16 | — |
| 6 | 20 | — | 7.03 | — |

*= composition according to the invention

EXAMPLE 3

In order to evaluate the influence of the nitrogen content of the stainless steel powder one melt was atomised and powder samples having different nitrogen content were prepared from the atomised powder by annealing in a nitrogen-containing atmosphere. As reference material powder annealed in an atmosphere of 100% of hydrogen was used. The powder samples were mixed with 1% lubricant and the obtained compositions were cold compacted at different pressures into specimens. The specimens were sintered at 1250° C. in an atmosphere of hydrogen for 45 minutes. The chemical analysis of the different powder samples is presented in table 7 except the nitrogen content, which was determined after annealing as presented in table 8. In table 8 the sintered density is presented for different specimens.

TABLE 7

| Batch | Cr % | Nb % | V % | Si % | Mn % | Ni % | P % | C % | S % |
|---|---|---|---|---|---|---|---|---|---|
| D | 12.14 | 0.01 | 0.29 | 0.83 | 0.13 | 0.05 | 0.001 | 0.017 | 0.012 |

TABLE 8

| Batch | Compaction pressure (MPa) | % N | Sintered Density (g/cm$^3$ |
|---|---|---|---|
| D1 | 600 | 0.056 | 7.18 |
| D1 | 700 | | 7.28 |
| D1 | 800 | | 7.36 |
| D2 | 600 | 0.072 | 7.13 |
| D2 | 700 | | 7.24 |
| D2 | 800 | | 7.31 |
| D(ref) | 600 | 0.019 | 7.23 |
| D(ref) | 700 | | 7.34 |
| D(ref) | 800 | | 7.39 |

It can be seen from example 3 that a nitrogen content above 0.07% will result in undesired sintered density.

The invention claimed is:

1. A pre-alloyed stainless steel powder comprising 10-30% by weight of chromium, 0.5-1.5% by weight of silicon, carbon in a concentration less than 0.1% by weight, nitrogen in a concentration less than 0.07% by weight, and less than 1% by weight of nickel, said powder further comprising vanadium in an amount of at least 4 times the combined amounts of carbon and nitrogen, wherein the amount of vanadium is 0.1-1% by weight.

2. The stainless steel powder according to claim 1, wherein the steel powder comprises 10-20% by weight chromium, 0.15-0.8% by weight vanadium, 0.7-1.2% silicon, carbon in a concentration less than 0.05% by weight, and nitrogen in a concentration less than 0.05% by weight.

3. The stainless steel powder according to claim 1, wherein the steel powder is essentially free of nickel.

4. A powder metallurgical composition comprising a stainless steel powder according to claim 1, which includes at least one additive selected from the group consisting of lubricants, flow agents, machinability improving agents and alloying elements.

5. A process of preparing compacted parts of stainless steel powder comprising the steps of:

subjecting a steel powder according to claim 1 to compaction, and sintering the compacted part at a temperature of 1150-1350° C.

6. The process according to claim 5, wherein sintering is made to a density of at least 7.20 g/cm$^3$.

7. A sintered part of stainless steel powder according to claim 1, having a sintered density of at least 7.20 g/cm$^3$.

8. The stainless steel powder according to claim 2, wherein the steel powder is essentially free of nickel.

9. A powder metallurgical composition comprising a stainless steel powder according to claim 2, which includes at least one additive selected from the group consisting of lubricants, flow agents, machinability improving agents and alloying elements.

10. A powder metallurgical composition comprising a stainless steel powder according to claim 3, which includes at least one additive selected from the group consisting of lubricants, flow agents, machinability improving agents and alloying elements.

11. A process of preparing compacted parts of stainless steel powder comprising the steps of:

subjecting a steel powder according to claim 2 to compaction, and sintering the compacted part at a temperature of 1150-1350° C.

12. A process of preparing compacted parts of stainless steel powder comprising the steps of:

subjecting a steel powder according to claim 3 to compaction, and sintering the compacted part at a temperature of 1150-1350° C.

13. A process according to claim 5 wherein, said stainless steel powder is mixed with a lubricant.

14. A sintered part of stainless steel powder according to claim 2, having a sintered density of at least 7.20 g/cm$^3$.

15. A sintered part of stainless steel powder according to claim 3, having a sintered density of at least 7.20 g/cm$^3$.

* * * * *